US005511443A

United States Patent [19]

Munekhoff

[11] Patent Number: 5,511,443

[45] Date of Patent: Apr. 30, 1996

[54] CABLE WINDOW LIFTER WITH A DRIVING UNIT

[75] Inventor: Bernd Munekhoff, Ebersdorf, Germany

[73] Assignee: Brose Fahrzeugteile GmbH & Co. KG, Coburg, Germany

[21] Appl. No.: 340,720

[22] Filed: Nov. 16, 1994

[30] Foreign Application Priority Data

Nov. 26, 1993 [DE] Germany ..... 43 40 842.7

[51] Int. Cl.[6] ..... G05G 1/08

[52] U.S. Cl. ..... 74/505; 49/352; 74/410; 74/606 R

[58] Field of Search ..... 49/352, 349, 360, 49/362; 74/410, 505, 606 R

[56] References Cited

U.S. PATENT DOCUMENTS 4,970,911 11/1990 Ujihara et al. ..... 49/352 X
5,035,083 7/1991 Kruzich ..... 49/352
5,279,468 1/1994 Kuster ..... 49/352 X

FOREIGN PATENT DOCUMENTS 2724962 3/1982 Germany .
8132167 11/1987 Germany .

*Primary Examiner*—Philip C. Kannan
*Attorney, Agent, or Firm*—Christie, Parker & Hale

[57] ABSTRACT

A cable window lifter with a driving unit includes a drive housing having an internal cavity therein. A cable drum is disposed within the internal cavity and has an internal gear provided along an internal portion of the drum. A pinion gear is disposed within the internal portion of the cable drum and includes teeth that engage the internal gear of the cable drum. The pinion gear is driven manually or by a motor. A support core is disposed between a portion of the internal gear of the cable drum and a portion of the pinion gear teeth. The support core prevents the lateral deflection of the pinion gear teeth out of the internal gear of the cable drum during imposition of an overload force onto the pinion gear, thereby assuring improved running quality of the driving unit and reducing the forces occurring in the driving unit.

8 Claims, 2 Drawing Sheets

CABLE WINDOW LIFTER WITH A DRIVING UNIT

FIELD OF THE INVENTION

The invention relates to a cable operated window lifter for use with vehicle windows and the like and, more particularly to a cable operated window lifter having a gear actuated driving unit.

BACKGROUND OF THE INVENTION

A cable window lifter for a window which can be lowered in window pocket of a vehicle is disclosed in German Patent Publication DE 81 32 167 U1. The cable window lifter has a guide rail disposed in the direction of movement of the window, along which a slide element is disposed displaceable in the longitudinal direction and which acts on the lower window edge and is connected with a driving cable of the cable window lifter. The driving cable is brought over deflection pulleys disposed on the upper and lower ends of the guide rail to a driving unit. The driving unit comprises a drive housing with a cable drum disposed therein for receiving the driving cable and a drive shaft. The drive shaft can be connected with a hand crank for manual operation of the cable window lifter or with a motor drive. Customarily the driving cable is disposed in a Bowden case fastened to Bowden supports of the drive housing. The driving cable itself is connected to the cylindrical surface of the cable drum and is connected in such a way that, when the drive shaft is moved in one or the other direction of rotation, the driving cable is wound onto or unwound from the cable drum, causing the carrier connected with the window and guided on the guide rail to be moved upward or downward.

The drive shaft for the cable drum can be disposed outside the longitudinal axis of the cable drum and can be connected with the cable drum via a gear connection. Alternatively, it is possible to provide the movement of the cable drum via a pinion gear disposed in the free cylindrical interior of the cable drum and engaging an internal gear of the cable drum. On one of its cylindrical front faces the pinion gear is connected via a pinion pin with a bearing bore disposed in the housing wall of the drive housing, and on its other front side with a drive shaft or directly or via engaging dogs with a hand crank.

If the pinion gear is driven in one or the other direction of rotation, a turning of the cable drum in the one or the other direction takes place via the connection of the pinion gear teeth with the internal gear of the cable drum. This causes the end of the driving cable, which is brought via the one Bowden support on the drive housing to the cable, to be wound up, and the cable end, which is brought via the other Bowden support on the drive housing to the cable drum and connected therewith, to be unwound.

The forces occurring in the cable window lifter described above during raising and lowering the window also act on the teeth of the pinion gear and the cable drum. As a result, in cases of overload, for example because of a window which moves tightly because of friction or is jammed, the pinion gear teeth are pushed out of the internal gear of the cable drum, so that the meshing between pinion gear and cable drum is severed. This can cause destruction of the teeth of the driving unit or breakage of the pinion bearing, due to the large loads on the bearing of the pinion gear so that in either case the driving unit is unable to function.

It is, therefore, the object of the invention to provide a cable window lift of the species mentioned at the outset, by means of which the engagement of the pinion gear teeth with the internal gear of a cable drum is assured with small expenditure even in cases of overload, and which also assures an improved running quality of the gear elements of the driving unit during normal operation.

SUMMARY OF THE INVENTION

A cable window lifter with a driving unit constructed in accordance with principles of this invention. The driving unit includes a drive housing having a cylindrical internal cavity therein. A cable drum having internal gear disposed around an interior portion of the drum is disposed within the housing cavity. A pinion gear is seated within the interior portion of the cable drum and includes teeth that engage the internal gear of the cable drum. The pinion gear is configured to be driven and accommodate manual or motor operated driving means. The pinion gear and cable drum are supported in an axial direction on a wall portion of the housing.

A support core is disposed within the cavity of the housing and is interposed between a portion of the internal gear of the cable drum and a portion of the pinion gear teeth. The support core operates to limit the amount of lateral movement by the pinion gear and, thereby ensuring engagement of the pinion gear teeth with the teeth of the internal gear even in cases where an overload force is being transmitted to the pinion gear. Additionally, use of the support core serve to keep overload forces away from the structural elements of the cable window lifter, so that the individual structural elements of the cable window lifter can be made less sturdy, which results in a lighter construction. At the same time the support core acts to make the forced lowering of the window of a cable window lifter more difficult.

BRIEF DESCRIPTION OF THE DRAWINGS

These and other features and advantages of the present invention will become appreciated as the same becomes better understood with reference to the specification, claims and drawings wherein:

DETAILED DESCRIPTION OF THE PREFERRED EMBODIMENT

Figure 1:
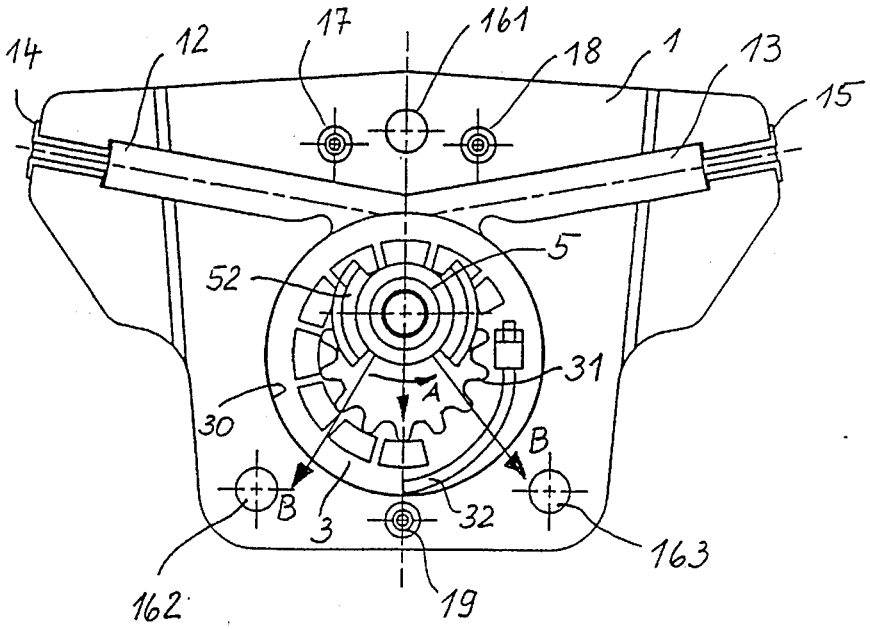
Fig. 1 PRIOR ART
FIG. 1 is a perspective top view of a prior art driving unit for a cable window lifter comprising a drive housing, a cable drum having an internal gear and a pinion gear, but without a support core.

FIG. 1 illustrates a top view of a prior art driving unit for cable window lifters disclosed in German Patent Publication DE 81 32 167 U1. The driving unit includes a drive housing 1 having two insertion channels 12 and 13 for accommodating therein a driving cable (not shown). Bowden cases for channels 12 and 13 are connected with the drive housing 1 at Bowden supports 14 and 15, respectively. The driving cable is connected by means of a respectively upper and lower deflection device with a carrier (not shown), which is displaceable on a guide rail (not shown).

A cable drum 3 is inserted into a hollow-cylindrical interior cavity 11 of the drive housing 1. A cylindrical outer surface 30 of the cable drum 3 is provided with cable guides for receiving the driving cable. An opening 32 in the cylindrical outer surface 30 of the cable drum 3 is used to receive and fasten end portions of the driving cable, which has been placed around the cylindrical outer surface 30 of the cable drum 3 in one or the other direction and has been inserted into the one or the other insertion channel 12 and 13 of the drive housing 1. A cylindrical interior portion of the cable drum 3 is provided with an internal gear 31, through which driving forces for moving the driving cable of the cable window lifter are transmitted. The internal gear includes teeth that extend outwardly from the interior portion and towards an axis along which the cable drum rotates.

A pinion gear 5 is disposed within the cylindrical interior of the cable drum 3 and comprises teeth 51 (see FIG. 2) on one front face that are in engagement with the internal gear 31 of the cable drum. The teeth 51 extend outwardly from the pinion gear and away from an axis along which the pinion gear rotates. The pinion gear also includes a pin 53 (see FIG. 2) that is seated in a bearing bore (not shown) of the drive housing 1. Alternatively, it is of course also possible that the housing wall of the drive housing 1 may have a pin for receiving an appropriate pinion bore. The pinion gear 5 has claws 52 on its other front face for receiving a hand crank for a manual movement of the cable window lifter or, alternatively, a shaft for connecting it with a driving motor when the cable window lifter is moved by means of a motor.

Centering pins 17, 18, 19 in the drive housing 1 are used for connecting the drive housing 1 with a window lifter base plate or with a second housing half of the drive housing 1. Attachment openings 161, 162, 163 are used for attaching the drive housing 1 to the window lifter base plate or the second housing half of the drive housing 1 by means of screws, rivets or other fastenings means.

When turning the pinion gear 5 of the prior art embodiment in the direction of the arrow A, in accordance with FIG. 1, a turning movement in the same direction of the cable drum 3 takes place, causing the end portion of the driving cable introduced through the one insertion channel 13 to be wound on the cable drum 3, and the end of the driving cable introduced through the other insertion channel 12 to be unwound. When large forces occur, such as in case of an overload, the teeth 51 of the pinion gear 5 are initially pushed out of the internal gear 31 of the cable drum 3 in the direction of the arrows B, in accordance with FIG. 1, because of the essentially one-sided seating of the pinion gear 5 in the drive housing 1. As a result of the pinion gear being pushed in the direction indicated by arrows B, pinion gear teeth 51 are allowed to engage adjacent portion of the internal gear 31 of the cable drum. This allows increased surface pressure to occur in the still remaining areas of engagement of the pinion gear teeth 51 with the internal gear 31 of the cable drum 3, which can lead to the stripping and destruction of the teeth. At the same time the bearing of the pinion gear 5 is placed under a large load, so that breaking of the pinion gear pin or of pin connected with the drive housing 1 can also take place. In either case, the prior art driving unit becomes unable to function, so that further operation of the cable window lifter is no longer possible.

Figure 2:
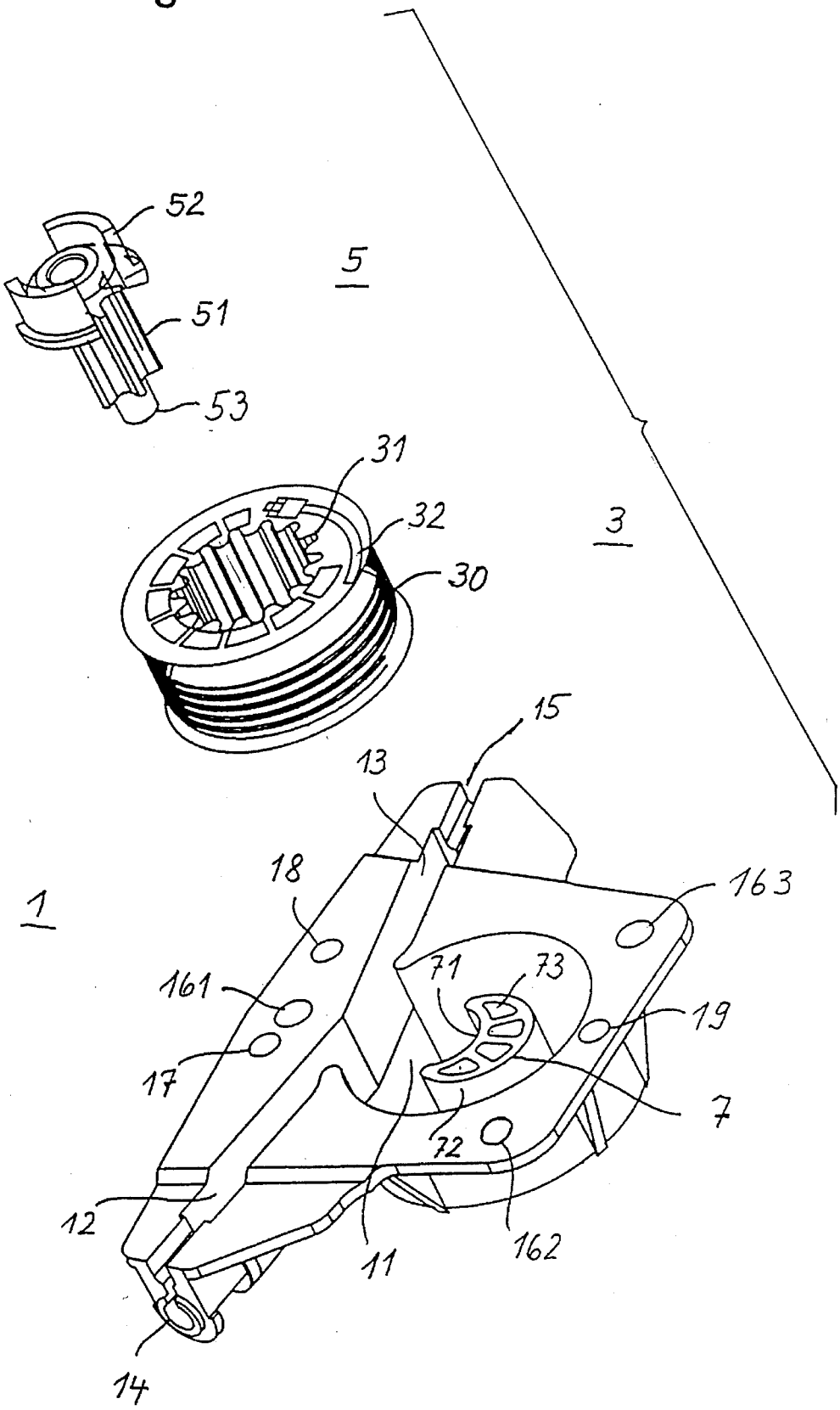
FIG. 2 is a schematic exploded view of an unassembled driving unit for a cable window lifter constructed according to principles of this invention, illustrating a perspective top view of a drive housing with a support core, and a cable drum and a pinion gear which is inserted into or connected in one piece within a housing half.

FIG. 2 illustrates an exploded view of a driving unit for a cable window lifter constructed in accordance with principles of this invention. A top view of the interior portion of the housing illustrates a drive housing 1 comprising a support core 7, which can be connected with the drive housing 1 in a positive and/or non-positive manner, i.e., be an integral or non-integral housing member, can be injection-molded in one piece with the drive housing 1 or can be inserted freely movable into the interior of the drive housing 1. The support core 7 is disposed within the cylindrical interior 11 of the drive housing 1 for receiving the cable drum 3 in accordance with FIGS. 2 and 3.

The support core 7 is preferably embodied in the shape of a disk and the like having a height that corresponds to the width of the teeth 51 and 31 of the pinion gear 5 and the cable drum 3, respectively. For purposes of clarity, the pinion gear 5 and cable drum 3 illustrated in FIG. 2, i.e., of the preferred embodiment, are the same as that previously described for the prior art embodiment of FIG. 1. The support core 7 has on one side a face portion that is adjacent to and rests on a wall portion of the drive housing 1, and on the other side a face portion that is adjacent to and rests on a wall portion of a second housing half of the drive housing or, alternatively, on a window lifter base plate for receiving the drive housing 1.

A surface portion 71 of the support core 7 that is adjacent to and faces the teeth 51 of the pinion 5 is configured having a concave shape, while a surface portion 72 of the support core 7 that is adjacent to and faces the internal gear 31 of the cable drum 3 is configured having a convex shape. Both the concave surface portion 71 and convex surface portion 72 of the support core 7 have surfaces that extend across a predetermined angle area of the gear teeth 51 of the pinion 5 and the internal gear 31 of the cable drum 3, respectively. In addition, the support core 7 has hollow spaces or reinforcement elements 73 disposed therein, wherein the latter simultaneously can be used for fastening the support core 7 on the housing wall of the drive housing 1. However, the reinforcement elements 73 can also be used exclusively for steadying a support core 7 formed from plastic material.

Figure 3:
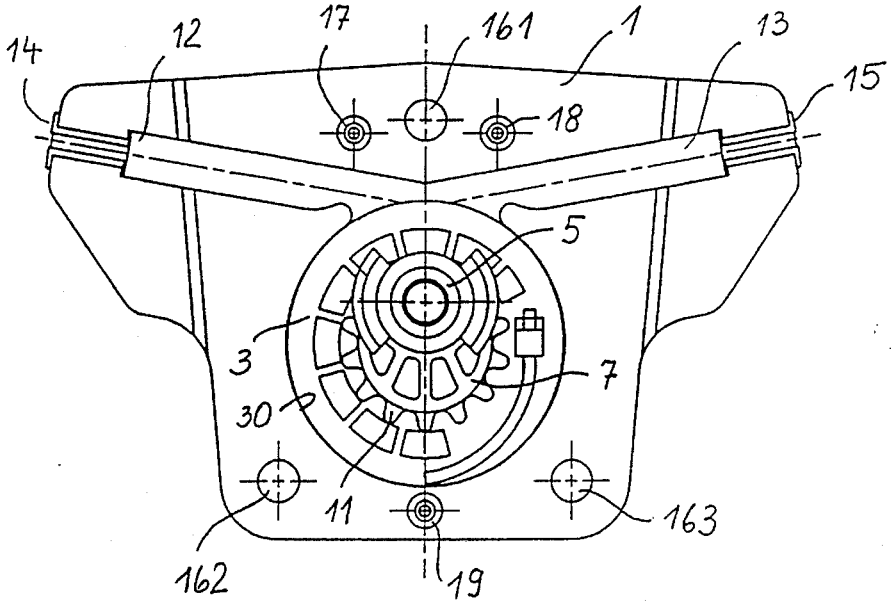
FIG. 3 is a perspective top view of a completely assembled driving unit of FIG. 2, comprising the drive housing with support core and the cable drum and pinion gear disposed therein.

FIG. 3 shows a completely assembled driving unit constructed according to principles of this invention, wherein the cable drum 3 inserted into the interior 11 of the drive housing 1 so that the support core 7 is inserted therein. The pinion gear 5 is inserted into the interior of the cable drum 3, and the support core 7 is interposed between a portion of the pinion gear 5 and a portion of the cable drum 3. The support core 7 fills to a large degree the free space remaining between the pinion gear 5 and the internal gear 31 of the cable drum 3. The support core 7 serves to limit the mobility of the pinion gear 5 in the direction extending through the axis of symmetry of the cable drum 3 and the bearing of the pinion gear 5.

The concave surface 71 of the support core 7 facing the pinion gear 5 prevents lateral deflection movement of the pinion gear 5 toward an opposite portion of the internal gear 31 when high resistance forces occur at the cable window lifter, and serves to reduced engagement of the pinion gear teeth 51 with the internal gear 31 of the cable drum 3. Thus, with the support core 7 fastened to one side of the housing wall of the drive housing 1 and a corresponding elastic embodiment of the support core 7, or with a support core 7 only inserted into the free interior of the cable drum 3 and the resulting corresponding free mobility of the support core 7, the effect when an overload occurs in the cable window lifter system is jamming of the cable drum 3 between the support core 7 and the hollow-cylindrical surface of the interior 11 of the drive housing 1 and a corresponding radial load on the pinion gear 5.

Because of the jamming of the cable drum 3 between the support core 7 and the hollow-cylindrical surface of the housing interior 11, the occurring overload forces are not transmitted to the window lifter system but, rather, are absorbed to a large extent by the non-positive connection between the cable drum 3, the support core 7 and the hollow-cylindrical surface of the housing interior 11, so that the overload forces are not passed on to the structural elements of the cable window lifter system. This in turn allows a lighter construction of the window lifter system and makes a forced lowering of the window lifter system difficult.

The attainment of the object in accordance with the invention with the provision of a support core between a portion of the internal gear of the cable drum and a portion of the pinion teeth ensures that even in cases of overload a defined engagement of the pinion gear teeth into the internal gear of the cable drum is assured, and that in normal operation it is ensured that there is constant engagement of the flanks of the pinion gear teeth with the internal gear of the cable drum. This has the further result of reducing the noise generation and wear and improving the running quality of the movable gear elements.

Attaining the object of this invention does not require any additional expenditures for the drive housing, so that no changes to the structurally simple design of the drive housing are required. Because of the improved transmission of the drive and overload forces, a further advantage of the invention resides in that the drive housing can even be made of a plastic material, because of which weight and costs are reduced in comparison with a structure made of metal.

An advantage of this invention is that the support core can be connected with the drive housing in a positive and/or non-positive manner. In this variant, a support core which is separate from the drive housing is inserted into corresponding receivers of the drive housing and/or is non-positively connected with the interior wall of the drive housing at the intended place by gluing or by screwing, riveting or the like. This requires no or only a small change of the drive housing when producing a support core with the least outlay by stamping or casting of a support housing made of a suitable material of plastic, sinter ceramics or metal.

A further advantage of this invention is that the support core can be injection-molded in one piece with the drive housing or can be inserted freely movable into the interior of the housing or the cable drum. In the one embodiment, the support core is directly manufactured during the injection-molding step of the housing or the appropriate half of the housing, so that no additional labor outlay is necessary for producing the support cores. In the other embodiment, a separately produced support core is inserted into the interior of the drive housing or of the cable drum without additional connecting steps. This, too, ensures a cost-effective simple production of a support core corresponding to the first variant of the invention and has the additional effect of an overload prevention.

If, in accordance with principles of this invention the support core is embodied to be movable or yielding in the load direction, this measure then has the effect, which can also be achieved with a freely movable support core, of an overload protection. This is so because in case of an overload the cable drum becomes jammed between the support core and the housing wall of the drive housing because of the radial load of the pinion gear, thereby eliminating the transmission of overload forces to the window system. Overload forces are kept away from the structural elements of the cable window lifter in this way so that the individual structural elements of the cable window lifter can be made less sturdy, which results in a lighter construction. At the same time the forced lowering of the window of a cable window lifter is made more difficult by this measure.

The disclosure of attached German patent application P 43 40 842.7 filed on Nov. 26, 1993, is incorporated full herein by reference. Priority of this German application is claimed.

It is to be understood that various modifications can be made in the design and operation of the present invention without departing from the spirit thereof. Thus, while a preferred construction and mode of operation of the invention have been explained in what is now considered to represent its best embodiment, it should be understood that within the scope of the appended claims, the invention may be practiced otherwise than as specifically illustrated and described.

What is claimed is:

1. A cable window lifter with a driving unit comprising:

a cable drum with an internal gear disposed around an interior portion;

a pinion gear seated within the interior portion of the cable drum, wherein the pinion gear includes teeth that engage the internal gear of the cable drum, and wherein the pinion gear is driven by driving means selected from the group consisting of manually operated and motorized driving means; and a drive housing accommodating the cable drum and the pinion gear therein, wherein the cable drum and pinion gear are supported in an axial direction on a wall portion of the housing, and wherein the drive housing includes:

a support core disposed within the housing and interposed between a portion of the internal gear of the cable drum and a portion of the pinion gear teeth.

2. A cable window lifter in accordance with claim 1 wherein the support core is connected with the drive housing in a positive manner.

3. A cable window lifter in accordance with claim 1 wherein the support core is connected with the drive housing in a non-positive manner.

4. A cable window lifter in accordance with claim 1 wherein the support core is injection-molded as an integral member of the drive housing.

5. A cable window lifter in accordance with claim 1 wherein the support core is inserted into the interior of the cable drum which has been inserted into the drive housing.

6. A cable window lifter in accordance with any one of claims 1, 2, 3, 4, and 5 wherein the support core is disposed movably or yieldingly in a direction of a load placed on the support core.

7. A cable window lifter in accordance with any one of claims 1, 2, 3, 4 and 5 wherein the support core has a concave surface portion adjacent the teeth of the pinion gear and a convex surface portion adjacent the internal gear of the cable drum, and wherein both the concave and convex surfaces extend across a predeterminable area of the pinion gear teeth and the internal gear, respectively.

8. A cable window lifter driving unit comprising:

a drive housing having an internal cavity therein;

a cable drum disposed within the cavity, wherein the cable drum has an open internal portion, and wherein the internal portion includes an internal gear having teeth that extend outwardly from wall portions of the internal portion and toward an axis of the cable drum;

a pinion gear disposed within the internal portion of the cable drum, wherein the pinion gear includes teeth that extend outwardly from the pinion gear and away from an axis of the pinion gear, wherein the teeth of the pinion gear engage teeth of the internal gear; and a support core disposed within the internal portion of the cable drum, wherein the support core is interposed between a portion of the pinion gear and the cable drum to limit lateral movement of the pinion gear within the internal portion of the cable drum.

* * * * *